United States Patent [19]

Holden

[11] 4,013,988

[45] Mar. 22, 1977

[54] HERMETICALLY SEALED MOTOR PROTECTOR

[75] Inventor: Ronald L. Holden, Mansfield, Ohio

[73] Assignee: Therm-O-Disc Incorporated, Mansfield, Ohio

[22] Filed: Jan. 19, 1976

[21] Appl. No.: 650,117

[52] U.S. Cl. ..... 337/89; 337/107; 337/377

[51] Int. Cl.[2] ..... H01H 51/34

[58] Field of Search ..... 337/89, 91, 94, 102, 337/107, 365, 367, 368, 377

[56] References Cited

UNITED STATES PATENTS

| | | | |
|---|---|---|---|
| 3,361,883 | 1/1968 | Brassard, Jr. et al. | 337/89 |
| 3,569,888 | 3/1971 | Taylor | 337/89 |
| 3,609,620 | 9/1971 | Lee | 337/102 |

*Primary Examiner*—George Harris
*Attorney, Agent, or Firm*—McNenny, Pearne, Gordon, Gail, Dickinson & Schiller

[57] ABSTRACT

A hermetically sealed motor protector or the like is disclosed in which a switch chamber is defined by a cylindrical, cup shaped element and a header welded to one end thereof. A pair of insulated pins extend through the header substantially parallel to each other and on opposite sides of the center axis of the device. A switch including a stationary contact mounted on one pin and a movable contact assembly supported by the other pin is arranged so that the line of action of the movable contact is along a diametrical plane inclined with respect to the pins. Such structure facilitates the assembly of the device. The structure is arranged so that the pins supporting the bimetal snap element limits movement of the free end thereof in a direction away from the fixed contact to reduce the tendency for calibration drift and fatigue cracking of the snap element. In one embodiment, a shunt formed of flexible material is connected in parallel to the bimetal snap element to provide greater current carrying capacity. In another embodiment, a resistance heater is connected in series with the bimetal snap element to increase current sensitivity. The offset structure allows the use of a straight resistance heater, positioned closely adjacent to the center line of the snap element for good heat transfer. The heater mounting is arranged to accommodate thermal expansion and contraction without altering the calibration of the device.

17 Claims, 5 Drawing Figures

HERMETICALLY SEALED MOTOR PROTECTOR

BACKGROUND OF THE INVENTION

This invention relates generally to motor overload protectors, and more particularly to a novel and improved hermetically sealed motor protector structured for ease of manufacture, low cost and reliable operation.

PRIOR ART

Hermetically sealed motor protectors are known in which a current responsive bimetal snap switch is located in a sealed switch chamber enclosed by housing assembly consisting of a metal cup closed by a switch header. Examples of such devices are described in the U.S. Letters Pat. Nos. 3,602,862 and 3,902,149, and the prior art of record in such patents. The prior art of record, U.S. Pat. No. 3,361,883, discloses an offset switch structure.

SUMMARY OF THE INVENTION

There are a number of aspects to the present invention. In accordance with one important aspect of this invention, a switch is supported on a pair of substantially straight and parallel pins so that the line of action of the switch is along a diagonal plane with respect to the support pins. In the illustrated embodiment, such diagonal reference plane is tangent to both pins. With such structure the welds connecting the switch element to the support pins are offset on opposite sides of the diagonal plane to east the tooling access for welding the parts. In addition, the switch arrangement facilitates the positioning of a heater closely adjacent to the center line of the snap disc element in those devices which incorporate heaters.

In accordance with another aspect of this invention, the switch is structured so that the fixed contact is located adjacent to the header and a cantilever mounted bimetal snap element is supported at a location remote from the header so that it extends back along its associated support pin to a free end adjacent to the fixed contact. The structure is arranged so that the pin which supports the bimetal snap element limits the over travel of the free end of the snap element in a direction away from the fixed contact. This structure reduces the tendency for calibration drift, and also reduces the likelihood of cracks developing in the snap element.

In the embodiment employing a heater, a structure is provided to accommodate thermal expansion and contraction of the heater so that such expansion and contraction does not alter the operation of the device. With this structure, it is possible to use a simple, straight, cylindrical heater.

In accordance with still another embodiment of this invention, a simple weld member is provided to support the bimetal snap element and is arranged to permit calibration of the assembled device by the simple expediency of bending the weld member until the snap element operates at the desired operating temperature. Also, the same weld member is used to connect the heater in embodiments employing heaters.

These and other aspects of this invention are discussed in greater detail in the following description.

DETAILED DESCRIPTION OF THE DRAWINGS

Figure 1:
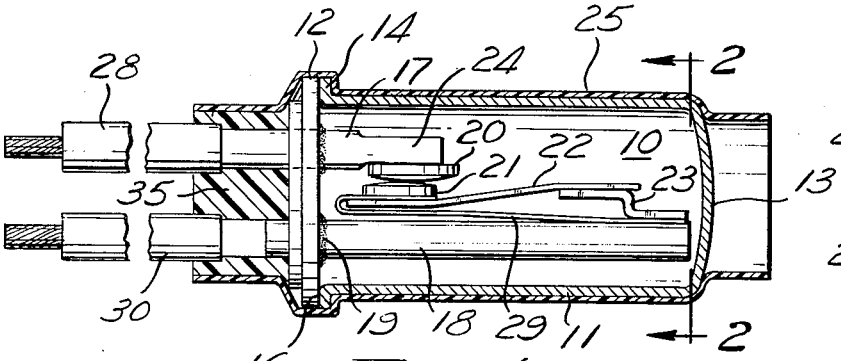
FIG. 1 is a side elevation sectioned to illustrate the internal structure of an embodiment employing a shunt.

Three related but different embodiments of this invention are disclosed. In one embodiment, illustrated in FIGS. 1 and 2, a shunt is connected in parallel with a bimetal snap element so that only a portion of the current flow through the device is carried by the bimetal snap element. Such devices with a shunt are normally utilized in higher current applications. In a second embodiment, illustrated in FIGS. 3, 4 and 5, a resistance heater is connected in series with the bimetal snap element and is positioned adjacent to such element to provide additional heating of the bimetal snap element other than the heating provided by the embodiment and the flow of current through the bimetal itself. Such embodiment is normally used in lower current applications with a heater operating to increase current sensitivity. In a third embodiment for use in mid-range current applications, the device is not provided with either a shunt or a heater. Instead, all of the current applied to the device is carried directly through the bimetal snap element and the heating of the element in response to such current is a result of the flow of the current through the bimetal snap element. Such embodiment has not been specifically illustrated in the drawings, since it consists of a structure identical to the structure of FIGS. 1 and 2 with the shunt eliminated from the structure of FIGS. 1 and 2. It should be understood, however, that such third embodiment is covered by this application and that it has not been specifically illustrated in the drawings merely to simplify the disclosure of this invention.

The basic structure of all embodiments is the same. In each embodiment a hermetically sealed switch chamber 10 is defined by a housing assembly including a cup shaped housing 11 and a header 12, which is welded to the housing 11 at its open end. The illustrated housing is cylindrical in section, is closed by an end wall 13 at one end, and is formed with a radially extending flange 14 at its open end to provide a base for the weld connection at 16 between the header 12 and housing member 11.

A pair of cylindrical support pins 17 and 18 extend through the header 12 into the switch chamber 10. The two support pins 17 and 18 are electrically insulated from the header 12 and are supported by a fused glass seal material 19 so that the hermetic seal of the chamber 10 is maintained. The use of such glass seals for conductors which extend through the wall of a hermetically sealed chamber into such chambers is well known and one source of such seals is the Fusite Corporation of Cincinnati, Ohio. Supported by the support pins 17 and 18 within the chamber 10 is a switch mechanism including a fixed contact 20 and a movable contact 21, supported on the free end of a bimetal snap element 22.

The bimetal snap element 22 is supported on its other end by a support bracket 23 which is, in turn, welded to the end of the support pin 18.

Figure 2:
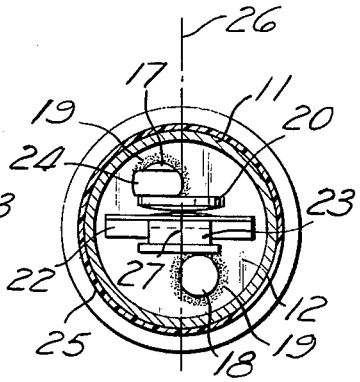
FIG. 2 is a cross section taken generally along 2—2 of FIG. 1.

The fixed contact 20 is welded to a flattened portion 24 of the support pins 17, and is offset, as best illustrated in FIG. 2, so that the fixed contact 20 is symmetrical with respect to a diagonal plane 26. In the illustrated embodiment, the diametrical plane contains the axis 27 of the device and is substantially tangent to the two support pins 17 and 18. The contact surface of the fixed contact 20 extends perpendicular to the plane 26 where it intersects the plane 26. By offsetting the weld joint between the fixed contact 20 and the support pin 17, as illustrated, ease of producing the weld is improved, since it is not necessary to fit the weld tooling in between the two pins 17 and 18. Similarly, the operation of producing the flattened portion is easier because the tooling for producing such portion need not project between the two support pins.

As best illustrated in FIG. 2, the support bracket 23 is welded to the support pin 18 so that it is offset with respect to the support pin 18, and is symmetrically located with respect to the diametrical plane 26. The offset arrangement also positions the snap element 22 and the movable contact 21 so that the line of action of the movable contact 21 is along the plane 26 and the contact surface at the point of engagement with the fixed contact 20 is perpendicular to the plane 26.

The bimetal snap element 22 is generally rectangular in shape, is formed with rounded corners, and has a shallow, dished shape center section, which causes the snap element to snap between two positions of stability upon reaching predetermined operating temperatures.

In the illustrated embodiment, the support pin 17 is relatively short and the fixed contact 20 is located adjacent to the header 12. The support pin 18 is substantially longer than the support pin 17 and the support bracket 23 is welded to the support pin 18 at a position on the side of the fixed contact 20, remote from the header. Consequently, the snap element 22 extends back along the switch chamber to a position substantially adjacent to the header for movement into and out of engagement with the fixed contact 20. Preferably, the various elements are proportioned so that the support pin 18 operates to limit the amount of over travel of the movable contact 21 in a direction away from the fixed contact to limit unnecessary over travel of the snap element 22. Preferably, the spacing however, is such that the snap element travel is not limited within the snap range so that the limitation of the travel of the snap element does not affect the closing temperature of the switch. The limitation of over travel tends to reduce calibration drift of the snap element and also tends to reduce the likelihood of cracking of the material of the snap element.

Positioned around the housing assembly is a tubular insulating sleeve 25. Preferably, such insulting tube or sleeve 25 is formed of a material such as mylar, which can be shrunk around the housing assembly to secure it in position, as illustrated. The U.S. Pat. No. 3,431,526 provides an example of a prior art device employing an insulating sleeve. A pair of leads 28 and 30 are connected to the two support pins 17 and 18, respectively, exteriorly of the switch chamber 10 so that the device may be connected in the circuit of an associated motor or the like. Preferably, a potting material 35, such as epoxy, is cast within the sleeve 25 to seal the junction between the two leads and the support pins. Thus, the insulating sleeve 25 performs a dual function of electrically insulating the device and also providing a mold cavity for the potting material 35.

As mentioned previously, many embodiments of this invention do not employ either a shunt or a heater, and such devices are provided with a structure of FIG. 1 without a shunt 29. However, devices which are required to carry heavy current loads are provided with a shunt 29 formed of thin copper material, which is connected in parallel with the bimetal snap element. Such shunt 29 is welded in position between the movable contact 21 and the free end of the bimetal snap element and is welded at its other end between the support pin 18 and the support bracket 23. With such a device, a portion of the current flowing through the device is carried by the shunt 29, so only a portion of the current through the device flows through the snap element 22. The resistance or current carrying capacity of the shunt is selected with respect to the resistance and current carrying capacity of the bimetal snap element, so that the desired proportional relationship in current flow is provided. Since the shunt has very low resistance, it reduces the amount of heating of the bimetal snap element for a given current and thereby allows the device to carry a greater current before causing the bimetal snap element to heat to a given operating temperature. It should be understood, however, that the shunt is formed of a material which is sufficiently flexible to allow free snap movement of the snap element so that it does not materially alter the operating characteristics of the snap element.

The calibration of the operating temperature device is preferably accomplished by bending the mounting portion of the support bracket 23 upwardly (as viewed in FIG. 1) while the snap element is at the desired operating temperature until the snap element is pulled in and snaps to the open position. In practice, the upward bending movement is continued a predetermined amount to compensate for springback. Such calibration procedure is simply accomplished and insures that the device operates at the required operating condition, even though the free state operating condition of the smap element may vary somewhat due to manufacturing tolerances. The tooling utilized for calibration is arranged to support the device so that the support pins 18 is not deflected during calibration.

Figure 3:
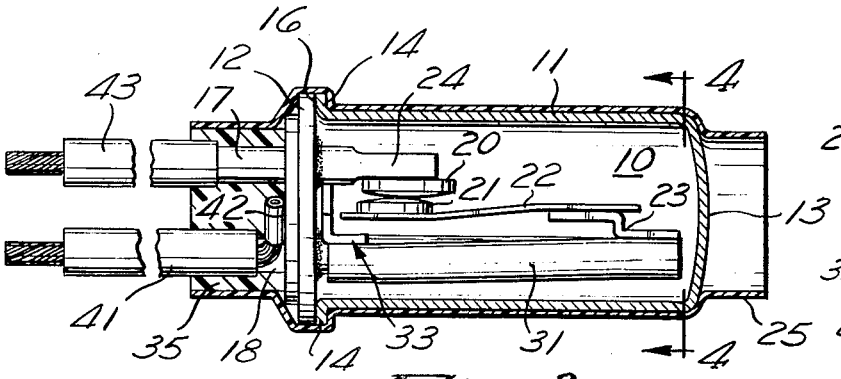
FIG. 3 is a side elevation similar to FIG. 1 of an embodiment employing a heater.
Figure 4:
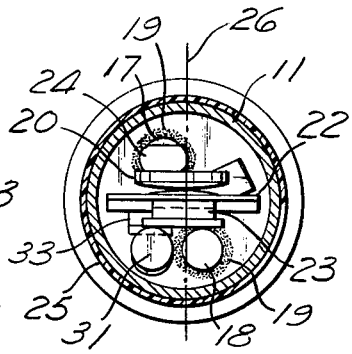
FIG. 4 is a cross section of the embodiment of FIG. 3 taken generally along 4—4 of FIG. 3; and, FIG. 5 is a fragmentary perspective illustrating the structural arrangement of the heater mounting.
Figure 5:
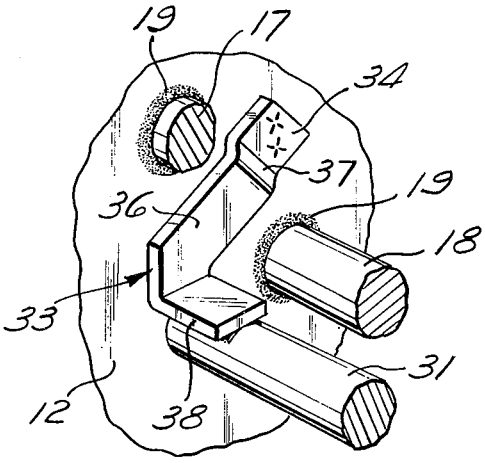

FIGS. 3 through 5 illustrate a second embodiment in which a heater 31 is connected in series with the bimetal snap element 22, to increase current sensitivity. In this illustrated embodiment, a simple cylindrical wire heater 31 is welded at its outer end to the support bracket 23, adjacent to but spaced from the support pin 18. The inner end of the heater 31 is welded to a heater support 33, best illustrated in FIG. 5.

The heater support 33 is formed with a mounting portion 34, welded to the header 12 and a free lateral portion 36, which is offset from the mounting portion 34 by a bend 37, so that the lateral portion 36 is spaced from the header 12, as best illustrated in FIG. 3. The heater support also provides an angulated flange 38, welded to the inner end of the heater 31. This structure, in which the lateral portion 36 is spaced from the header 12, allows for expansion and contraction of the heater 31 without producing significant stresses on the support pin 18, and thereby prevents the heater 31 from altering the calibration of the device, due to thermal expansion and contraction. The weld between the support 36 and the header at 34 is preferably located on the side of the support pins 17 and 18, remote from the heater 31 so that sufficient length is provided in the lateral portion 36 to accommodate the expansion and contraction of the heater wthout producing sufficient stress to cause the outer end of the support pin to be moved as a result of such expansion and contraction.

In the embodiment of FIGS. 3 through 5 in which the heater is employed, one lead 41 is connected directly to the header 12 at 42 and the other lead 43 is connected to the support pin 17. With such connection wherein a lead is not connected to the support pin 18, the heater 31 is in series with the snap element 22 and all current flowing through the device flows both through the heater 31 and the snap element 22. The heat generated by the current passage through the heater 31 is transmitted to the snap element 22 to augment the heating of the snap element 22, caused by the current flow directly therethrough and to cause snap element operation at lower current flow ratings than would be produced if a heater were not provided.

As best illustrated in FIG. 4, the heater 31 is positioned at a location spaced slightly from the support pin 18, but substantially parallel thereto so that the heater 31 is closed to the center line of the snap element 22 for good heat transfer relationship therewith. Here again, the offset structure of the switch mechanism facilitates the positioning of the heater 31 in good heat transfer relationship with the snap element to improve operating sensitivity.

It should be recognized that the illustrated embodiments of this invention utilize identical basic structural elements and that the embodiment of FIG. 1 differs from the other embodiments in that a shunt is provided in the embodiment of FIG. 1 and the embodiment of FIG. 3 differs from the other embodiments in that a heater is supplied in such embodiment. Consequently, manufacturing costs are minimized because it is not necessary to provide excessive parts inventories and because basic tooling may be used in all three embodiments of this invention.

Although preferred embodiments of this invention are illustrated, it should be understood that various modifications and rearrangements of parts may be resorted to without departing from the scope of the invention disclosed and claimed herein.

What is claimed is:

1. A motor protector comprising a housing assembly defining a hermetically sealed switch chamber, a pair of substantially straight and parallel support pins extending into said chamber, said support pins being electrically isolated from each other, a bimetal snap assembly cantilever mounted by welding to one support element, said bimetal snap assembly including a movable contact mounted on the free end thereof, a fixed contact welded to the other support pin, said bimetal assembly operating in response to predetermined bimetal temperatures to move said movable contact along a line of action into and out of engagement with said fixed contact, a reference plane containing said line of action and being substantially parallel to and spaced from the axes of said support pins, the weld between one said support pin and said bimetal snap assembly being spaced from and on one side of said reference plane, and the weld between said fixed contact and said other support pin being spaced from and on the other side of said reference plane.

2. A motor protector as set forth in claim 1 wherein said bimetal snap assembly is cantilever mounted on the end of said one support pin and extends back along the length of said one support pin to its free end.

3. A motor protector as set forth in claim 2 wherein said one support pin limits movement of said free end of said bimetal snap assembly in a direction away from said fixed contact.

4. A motor protector as set forth in claim 1 wherein a substantially straight resistance heater wire is connected in series with said bimetal snap assembly and extends substantially parallel to said one support pin.

5. A motor protector as set forth in claim 4 wherein said resistance heater is mounted at one end on said one support pin and is supported at its other end by resilient means operable to accommodate lengthwise thermal expansion and contraction of said heater.

6. A motor protector as set forth in claim 5 wherein said support pins are electrically isolated from said housing and extend through the wall thereof, and said resilient means includes a lateral metallic member welded to said housing on one side of said support pin and providing a free section extending between said support pins to an end welded to said other end of said resistance heater.

7. A motor protector as set forth in claim 1 wherein a flexible shunt is connected between said movable contact and said one support pin.

8. A motor protector as set forth in claim 7 wherein said bimetal assembly includes a support member welded at one location to a bimetal snap element and at another location to said one support pin.

9. A motor protector as set forth in claim 8 wherein said support member is bendable for calibration of the operation of said bimetal snap assembly.

10. A motor protector as set forth in claim 9 wherein said shunt is welded between said support member and said one support pin.

11. A motor protector as set forth in claim 1 wherein a shunt is connected in parallel with said bimetal snap assembly.

12. A motor protector comprising a housing assembly including elongated cylindrical cup shaped housing member and a header cooperating to define a hermetically sealed switch chamber, first and second substantially parallel electrically insulated support pins extending through said header into said switch chamber, a fixed contact welded to said first pin so that it provides a contact face substantially perpendicular to and located at a central plane diagonal with respect to both of said pins whereby the weld joint between said first pin and first contact is offset to one side of said plane, said second pin extending to a location spaced from said header beyond said fixed contact, a support member welded to said second pin at said location with the weld joint offset on the other side of said plane, an elongated bimetal snap element mounted at one end on said support member and extending substantially symmetrical with respect to said plane to a free end, and a movable contact on said free end movable with snap action with a line of action along said plane into and out of contact with said fixed contact.

13. A motor protector as set forth in claim 12 wherein a substantially straight resistance heater is connected at one end to said housing and at the other end to said second pin, said heater extending substantially parallel to said bimetal snap element at a location substantially adjacent to the center thereof.

14. A motor protector as set forth in claim 13 wherein means are provided to accommodate thermal expansion and contraction of said heater without adversely affecting the calibration of said bimetal snap element.

15. A motor protector as set forth in claim 12 wherein a shunt is connected in parallel with said bimetal snap element to carry a portion of the current applied to said motor protector.

16. A motor protector as set forth in claim 12 wherein central plane is substantially tangential to said support pins.

17. A motor protector as set forth in claim 12 wherein said first support pin is formed with a flat, and said fixed contact is welded to said flat.

* * * * *